US006968964B2

(12) United States Patent
Gilmore

(10) Patent No.: US 6,968,964 B2
(45) Date of Patent: Nov. 29, 2005

(54) NIPPLE CONFIGURATION FOR USE IN FEEDING AND NURSING NEWBORN INFANTS

(76) Inventor: Carolyn K. Gilmore, 1805 Springbrook Way, Newberg, OR (US) 97132

( * ) Notice: Subject to any disclaimer, the term of this patent is extended or adjusted under 35 U.S.C. 154(b) by 73 days.

(21) Appl. No.: 10/392,788

(22) Filed: Mar. 19, 2003

(65) Prior Publication Data

US 2004/0182813 A1 Sep. 23, 2004

(51) Int. Cl.[7] ..... A61J 9/00; A61J 11/00; A61J 13/00; A61J 17/00

(52) U.S. Cl. ..... 215/11.1; 215/11.4; 128/890; 606/234; 606/236

(58) Field of Search ..... 215/11.1, 11.3, 215/11.4; 128/890; 604/76; 606/234–236

(56) References Cited

U.S. PATENT DOCUMENTS

| | | | | | |
|---|---|---|---|---|---|
| 1,985 | A | | 2/1841 | Windship | |
| 71,459 | A | * | 11/1867 | Clark | 604/76 |
| 77,393 | A | | 4/1868 | McLaughlin | |
| 196,594 | A | * | 10/1877 | Patch | 128/890 |
| 322,508 | A | * | 7/1885 | Ware | 604/76 |
| 751,415 | A | | 2/1904 | Prindle | |
| 1,012,478 | A | * | 12/1911 | Stern | 49/231 |
| 1,012,980 | A | | 12/1911 | Brophy | |
| 1,082,198 | A | * | 12/1913 | Jencsa | 128/890 |
| 1,095,264 | A | * | 5/1914 | Bridges | 606/235 |
| 1,099,082 | A | | 6/1914 | Decker | |
| 1,207,120 | A | * | 12/1916 | Younker | 215/11.1 |
| 1,465,748 | A | * | 8/1923 | Weld | 215/11.1 |
| 1,605,427 | A | * | 11/1926 | Delmas | 215/11.1 |
| 1,656,157 | A | * | 1/1928 | Correnti | 215/11.1 |
| 1,759,568 | A | | 5/1930 | Fervers | |
| 2,364,866 | A | | 12/1944 | Meynier, Jr. | 128/150 |
| 2,366,214 | A | | 1/1945 | Ramaker | 128/252 |
| 2,388,915 | A | | 11/1945 | Heilborn | 128/252 |
| 2,517,457 | A | * | 8/1950 | Allen | 215/11.3 |
| 2,655,920 | A | * | 10/1953 | Cronin | 215/11.1 |
| 2,680,441 | A | * | 6/1954 | Krammer | 604/217 |
| 2,699,169 | A | | 1/1955 | Perreault | 128/252 |
| 2,767,871 | A | * | 10/1956 | Shapiro | 215/11.5 |
| 2,803,250 | A | * | 8/1957 | Barr | 215/11.5 |
| 2,816,547 | A | * | 12/1957 | Adisman | 215/11.1 |
| 2,939,598 | A | * | 6/1960 | Donleavy | 215/11.1 |
| 3,172,561 | A | | 3/1965 | Schwartz | 220/90.2 |
| 3,500,831 | A | * | 3/1970 | Schaar | 215/11.5 |
| D262,575 | S | | 1/1982 | Araujo, Jr. | |

(Continued)

FOREIGN PATENT DOCUMENTS

| | | | | |
|---|---|---|---|---|
| EP | 1275366 A2 | * | 1/2003 | A61J 11/00 |

(Continued)

*Primary Examiner*—Sue A. Weaver
(74) *Attorney, Agent, or Firm*—Holland & Knight LLP

(57) ABSTRACT

A nipple configuration for use on baby bottles and in breast shields particularly adapted for feeding and nursing newborns. The configuration includes body and nipple portions integrally formed of a soft flexible material and defining raised ridges or other surface irregularities thereon so as to provide the feel of a mother's breast and nipple. The nipple projects outwardly from the body portion and defines a fluid passageway extending axially therethrough and a plurality of discharge openings in the extended end thereof. A flexible reinforcing tube extends through the passageway communicating the fluid openings with the interior of the body portion and preventing the nipple from collapsing upon being sucked by a newborn. The device can also be used on a pacifier for developing the sucking reflex and, in a modified form, for feeding and nursing newborns having a cleft-lip or palate.

20 Claims, 2 Drawing Sheets

U.S. PATENT DOCUMENTS 4,505,398 A * 3/1985 Kesselring ..... 215/11.5
4,623,069 A * 11/1986 White ..... 215/11.1
4,632,263 A 12/1986 Gertzman ..... 215/11
4,856,663 A 8/1989 Epp ..... 215/11.1
5,078,733 A * 1/1992 Eveleigh et al. ..... 606/236
5,108,686 A 4/1992 Griffin ..... 264/222
5,178,291 A * 1/1993 Piercey ..... 215/11.1
5,474,193 A * 12/1995 Larsson et al. ..... 215/11.4
5,478,325 A * 12/1995 Fu-Hsiang ..... 604/212
5,578,004 A * 11/1996 Liang ..... 604/77
5,938,053 A * 8/1999 Verbovszky et al. ..... 215/6
6,161,710 A 12/2000 Dieringer et al. ..... 215/11.4
6,241,110 B1 6/2001 Hakim ..... 215/11.1
6,253,935 B1 * 7/2001 Fletcher ..... 215/11.1
6,270,519 B1 * 8/2001 Botts ..... 606/236
2002/0065537 A1 * 5/2002 Bass, Jr. et al.
2003/0093121 A1 * 5/2003 Randolph

FOREIGN PATENT DOCUMENTS

JP 2000325433 A * 11/2000 ..... A61J 13/00
JP 2002011076 A * 1/2002 ..... A61J 11/00

* cited by examiner

NIPPLE CONFIGURATION FOR USE IN FEEDING AND NURSING NEWBORN INFANTS

The present invention relates to a new nipple configuration for use on baby bottles and in breast shields for feeding and nursing newborns. The device can also be used on a pacifier for developing the sucking reflex and, in a modified form, for feeding and nursing newborns having a cleft-lip or palate.

The sucking reflex of a newborn (up to about one month of age) is rarely as coordinated as that of older babies. The newborn has not learned to suck at a sustained rhythm before birth as he or she has never previously had to do so to get the fluid they might have wanted or needed before birth. It rushed automatically into their mouth with the smallest amount of opening. It is now known that after about 13–16 weeks, the developed fetus begins sucking his or her thumb. They might also suck their fingers, tongues or lips and when very tiny, even a knee, toe or ankle. After he or she is born, they are introduced to life with a nipple that is yet a different shape, dry, softer and one that takes considerably more energy to obtain just a trickle of fluid. Due to the habit of receiving fluid without using the sucking reflex before birth, it is not surprising that the newborn may not take to a bottle or his mother's nipple.

The newborn may also have a very tender nose causing him to draw away from pressure placed on the nose by the mother's breast tissue. The newborn may have swollen membranes within his nose reducing the air passageways therethrough and again causing the newborn to draw away from his mother's breast as he can not get enough air through the nose. Most mother's nipples are relatively flat so that there is not enough length to accommodate the newborn's tender or swollen nose resulting from the birth process. Many natural nipples are so flat or short that even if the infant's nose were not tender, the nipple would not extend far enough into its mouth to stimulate a sucking reflex. Many bottle nipples are also too short for newborns. As a result of all of these factors, when a nipple is placed in front of a newborn's mouth, the extrusion reflex activity generally takes over and the infant spits out the nipple. Newborns will more readily suck on a finger because fingers are easier to place far enough into their mouths so that the sucking reflex will take over the extrusion reflex.

Because of the increase of women in the workforce in today's society and the concurrent drop in availability of wet nurses, baby bottles play an increasing role in the feeding of newborns. It is therefore desirable that the nipple used with baby bottles be configured so as to address the above-discussed feeding problems facing newborns. Such a configuration should encourage and help develop the sucking reflex and thus greatly facilitate fluid intake by the newborn. Because of increasing nutritional awareness and concern over contaminated canned milk, nursing and bottle feeding newborns with breast milk has become increasingly popular. As a result, and because so many mother's nipples are too short to be ideally suited for breast feeding and others are overly sensitive, the use of breast shields has become increasingly widespread. It is therefore desirable that the nipple configuration on breast shields also address the same issues facing newborns to facilitate fluid intake and encourage the habit of sucking to develop the sucking reflex.

In addition to the above-discussed feeding needs, many infants are born with cleft-lips and/or palates making the fluid intake process even more difficult. It would therefore also be desirable if a nipple configuration could be developed for use with baby bottles and in breast shields that accommodated newborns with these disabilities. The present invention provides just such a nipple construction.

SUMMARY OF THE INVENTION

Briefly, the present invention is directed to a nipple configuration particularly adapted for use on baby bottles and breast shields for feeding and nursing newborns. The nipple configuration of the present invention is formed of a soft flexible material and comprises a curved body portion having a convex outer surface and an outwardly projecting hollow nipple. The convex outer surface of the body portion defines a plurality of raised ridges thereon configured so as to provide a somewhat rough surface resembling the mother's areola. The nipple is provided with similar surface irregularities, a plurality of fluid discharge openings in the extended end thereof and a hollow reinforcing tube axially disposed within the nipple to provide a fluid passageway therethrough communicating the interior of the body portion with the fluid discharge openings and preventing the nipple from collapsing in response to the infant's sucking thereon. Thus, the present invention both provides the baby bottle with the feel of a mother's breast and nipple, thereby facilitating switching back and forth between breast and bottle feeding as the need arises, and facilitates fluid extraction from the bottle and the development of the sucking reflex.

The same nipple construction can be employed in a breast shield. When used in a breast shield, a second fluid passageway can be provided in the curvilinear body portion of the shield that is in fluid communication at its downstream end with the reinforcing tube and is adapted for fluid communication at its upstream end with a separate reservoir of breast milk or formula to provide a supplemental feeding system for the newborn.

To accommodate infants with cleft-lips and/or palates, the nipple configuration is provided with a pair of opposed radially projecting and tapered flaps extending along the length of the nipple so as to form an artificial palate within the newborn's mouth to facilitate suction and prevent gagging.

DETAILED DESCRIPTION OF THE PREFERRED EMBODIMENTS

Figure 1:
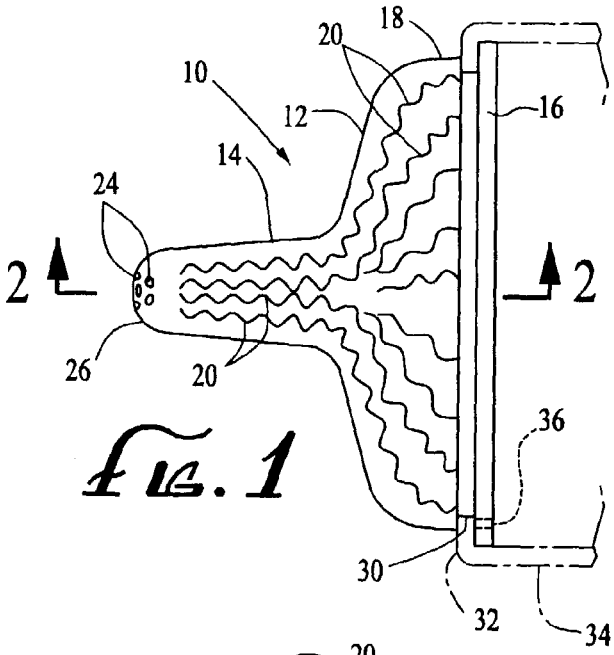
FIG. 1 is a perspective view of the nipple configuration of the present invention adapted for use on baby bottles.
Figure 2:
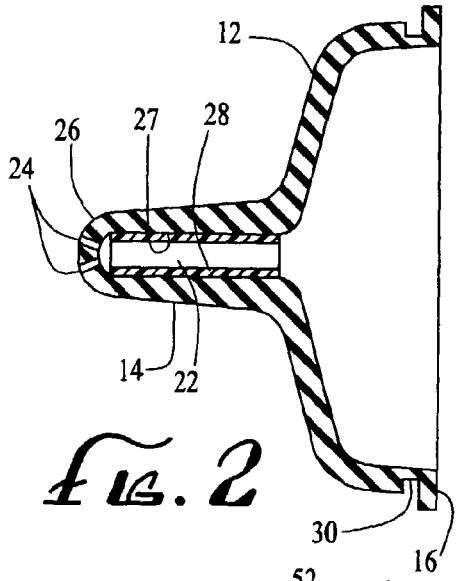
FIG. 2 is a sectional view taken along the line 2—2 in FIG. 1.
Figure 3:
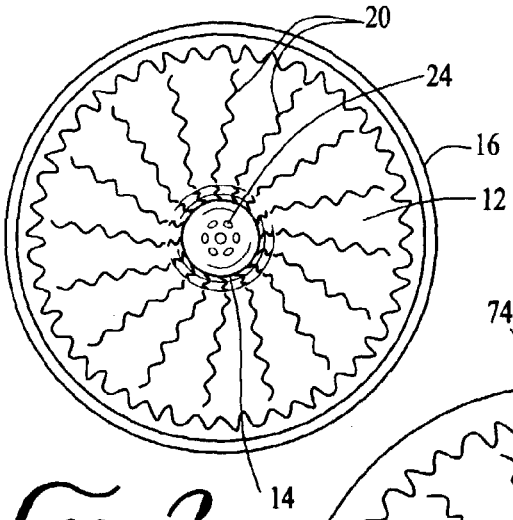
FIG. 3 is an end view of the nipple configuration of FIG. 1.

Referring now in detail to the drawings, the nipple configuration of the present invention adapted for use on baby bottles is illustrated in FIGS. 1–3. The nipple assembly 10 is preferably molded of a soft flexible material such as latex or other suitable material and is comprised of a body portion 12, nipple 14 and base 16. The body portion 12 is of a curvilinear configuration defining a convex outer surface 18 having an irregular surface defined by a plurality of raised non-linear ridges 20 formed therein at least over a substantial portion thereof so as to replicate the feel or tactile surface characteristics of the relatively rough skin of a mother's areola. Protuberances and/or depressions of a wide variety of configurations could be employed to provide the desired irregular surface. The nipple 14 projects outwardly from the apex of surface 18, is approximately 1.0 to 1.125 in. in length so as to help prevent the extrusion reflex in newborns, and defines a longitudinal channel 22 extending therethrough that terminates in a plurality of fluid discharge openings 24 in the extended end 26 thereof. The outer surface of the nipple 14 also defines ridges 20 or other surface irregularities therein so as to simulate the texture of the mother's nipple.

A flexible hollow reinforcing tube 28 is provided in channel 22 communicating the interior of the body of the nipple with the discharge openings 24. Tube 28 is preferably formed of a less flexible material than nipple 14 so as to reinforce the nipple such that it is still somewhat flexible but will not collapse as a result of an infant sucking thereon. Thus, the combination of nipple length, the very soft outer nipple material and the reinforcing tube 28 provides the nipple 14 with the feel and flexibility of a mother's nipple and a structure that facilitates withdrawal of fluid therefrom through discharge openings 24.

The base 16 of assembly 10 can be of any conventional form for use with baby bottles currently in use. Typically, the base 16 will define an annular groove 30 therein adapted to receive an inwardly directly flange portion 32 of a conventional plastic nipple retainer cap 34 that threadably engages the baby bottle (not shown). Base 16 also includes a plurality of apertures 36 therein that cooperate with similar openings in the flange portion 32 of the nipple cap 34 to provide air passageways into the interior of the baby bottle to prevent a vacuum buildup within the bottle which would otherwise cause the nipple to collapse as fluid is removed therefrom in response to the sucking of the infant. It is to be understood that other base configurations could be employed with the present invention to provide a securement of the nipple assembly to a baby bottle.

Figure 4:
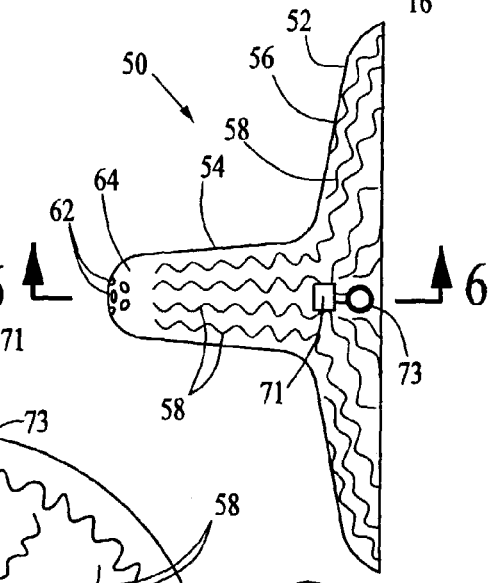
FIG. 4 is a perspective view of a breast shield employing the nipple configuration of the present invention.
Figure 5:
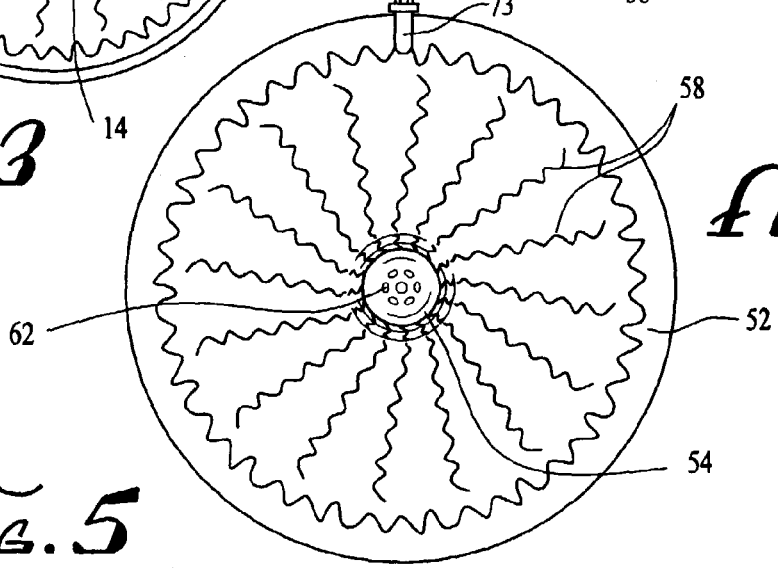
FIG. 5 is a frontal plan view of the breast shield shown in FIG. 4.
Figure 6:
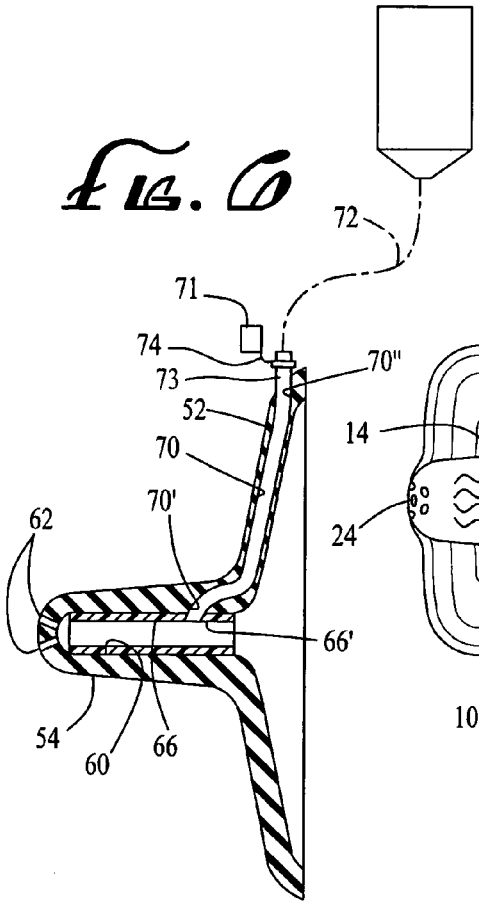
FIG. 6 is a sectional view taken along the line 6—6 in FIG. 4.

FIGS. 4–6 illustrate the adaptation of the nipple construction of the present invention in a breast shield 50. Breast shield 50 is similar to and formed of the same material as nipple assembly 10. Shield 50 comprises a body portion 52 and nipple 54 and is similarly formed of a soft flexible material so as to define an outer curvilinear convex surface 56 having raised ridges or other surface irregularities 58 formed over at least a substantial portion thereof to simulate the relatively rough surface of the mother's areola. Similar ridges or other surface irregularities 58 are again formed in the outer surface of the nipple 54. The nipple 54, like nipple 14, is about 1.0 to 1.125 in. in length and defines a longitudinal channel 60 extending therethrough and discharge openings 62 in the extended end 64 thereof. A flexible hollow reinforcing tube 66 is disposed within channel 60 communicating the discharge openings 62 with the interior of the body portion 52 of the breast shield 50. The interior surface of the body portion 52 of shield 50 is smooth so as to be comfortable against the mother's breast and assist in clinging to the skin as the infant creates sucking thereon while nursing through the shield. The interior portion of the breast shield 50 adjacent the upstream end of reinforcing tube 66 is configured so as to snugly receive a mother's nipple therein so that when the newborn sucks on the elongated nipple 54 of breast shield 50 the suction is transmitted to the mother's nipple to effect milk discharge therefrom. Preferably, the breast shield 50 would be designed in different sizes to accommodate the tiny mouth of the newborn and to snugly receive natural nipples of varying size and protrusion.

In the preferred embodiment of shield 50, the body portion 52 is provided with a fluid passageway 70 therein communicating at its downstream end 70' with the upstream end 66' of the reinforcing tube 66. The upstream end 70" of passageway 70 is adapted to receive a supplemental feeding tube 72 communicating with a reservoir of breast milk or formula (not shown) so as to provide a supplemental feeding system for the infant. The upstream end 70" of passageway 70 is provided with a closure 71 to prevent air from being ingested by the newborn through passageway 70 when the supplemental feeding system is not being used. In the preferred configuration, passageway 70 is molded into the body portion 52 of the shield and the upstream end 70" projects from the body portion 52 of the shield as a tubular extension 73 and closure 71 is of a cap configuration attached to the base of extension 73 by a flexible webbing 74 (see FIG. 6). Other passageway configurations and closures, including the use of a separate flexible tube communicating with the upstream end 66' of tube 66, could also be employed to provide a supplemental feeding system.

In those instances in which the supply of milk that the infant is receiving from the mother through the breast shield 50 is inadequate, the above-described supplemental system could be employed to supplement or replace the mother's milk via tube 72, passageway 70, reinforcing tube 66 and discharge openings 62. As the breast shield 50, like nipple assembly 10, provides a nipple of adequate length and has the same feel as the mother's breast and nipple, the shield 50 facilitates the development of the sucking reflex so that in many cases the use of the shield can be discontinued, if desired, and the mother can nurse naturally without an aid. In addition, the shield provides the same feel as baby bottles required with nipple assembly 10, making it considerably easier for the mother to switch back and forth between bottle and breast feeding.

Figure 7A:
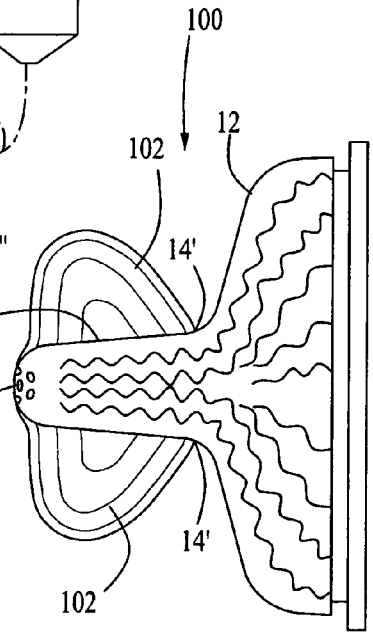
FIG. 7A is a perspective view of the nipple configuration of the present invention adapted for use with infant's having a cleft-lip and/or palate.
Figure 7B:
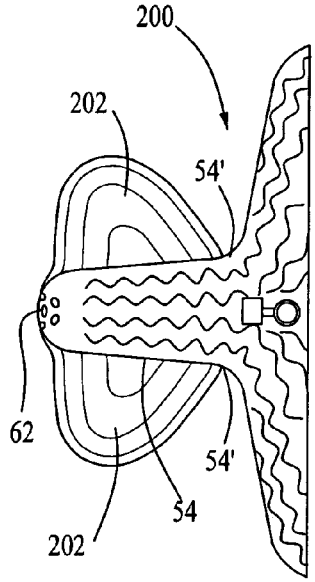
FIG. 7B is a perspective view of the nipple configuration of FIG. 7A employed in a breast shield.
Figure 8:
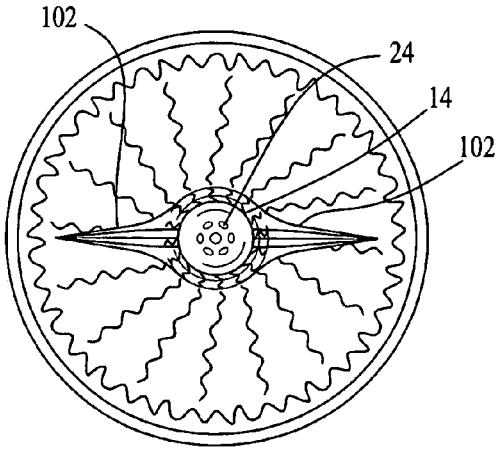
FIG. 8 is an end view of the nipple configuration of FIG. 7A.

Modified forms of the nipple assembly 10 and breast shield 50 adapted for use with infant's with cleft-lips and/or palates are illustrated in FIGS. 7A, 7B and 8 respectively. The nipple assembly 100 and breast shield 200 illustrated therein are identical to the above-described nipple assembly 10 and breast shield 50 except for the addition of the lateral flaps 102 and 202 illustrated in FIGS. 7A and 7B. Flaps 102 are identical to flaps 202 and in each case, project along and from opposed lateral sides of the nipple, extend the length of the nipple and are configured so as to define curved perimeter edges converging toward the inner ends 14' and 54' of the respective nipples. The flaps 102 and 202 are also tapered outwardly from the nipple such that the flaps are relatively thin at their outer edges. Through such a configuration, the flaps will conform to fit the newborn's misshapen mouth so as to facilitate sucking while preventing gagging.

Figure 9:
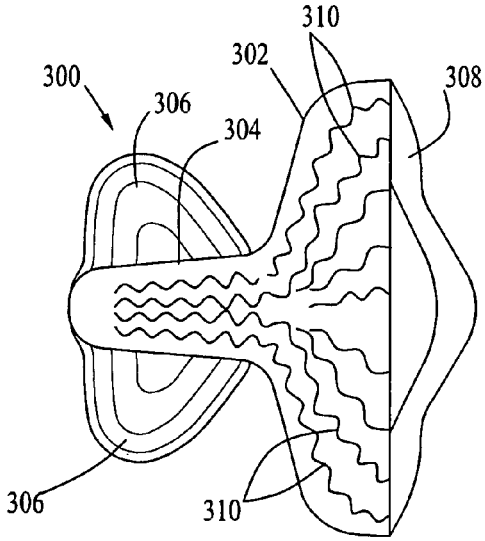
FIG. 9 is a top view of a pacifier embodying the present invention and adapted for infants with cleft-lips and/or palates.

As shown in FIG. 9, the above-described configuration can also be formed into a pacifier for use by infants having cleft-lips and/or palates to help develop the proper sucking reflex. As seen therein, the pacifier 300 includes a convex body portion 302, nipple portion 304, flaps 306 and a plastic ring 308. The body portion and nipple portion are, as in the prior embodiments, preferably provided with a plurality of raised ridges or other surface irregularities 310 thereon. Because the pacifier is not used to supply fluid therethrough, it does not include the discharge openings in the end of the nipple, nor need it include a reinforcing tube about a passageway. While the nipple and body portions of the pacifier are preferably again formed of soft flexible material, the nipple portion can be of sufficient thickness to provide a rigidity similar to that of a mother's nipple. A reinforcing tube or other element, however, could be employed if desired.

Various changes and modifications may be made in carrying out the present invention without departing from the spirit and scope thereof. Insofar as those changes and modifications are within the purview of the appended claims, they are to be considered as part of the present invention.

What is claimed is:

1. A nipple configuration for use on baby bottles and in breast shields particularly adapted for simulating a mother's breast in the feeding and nursing newborns, said configuration comprising:

body and nipple portions integrally formed of a soft flexible material, said body portion defining a convex outer surface disposed about an interior area;

said nipple portion projecting outwardly from said body portion and defining a fluid passageway extending axially therethrough and a plurality of fluid discharge openings in an extended end thereof wherein said nipple portion and said convex outer surface of said body portion define surface irregularities thereon to simulate the outer surfaces of a mother's nipple and areola; and a flexible reinforcing tube extending through said passageway communicating said fluid openings with said interior of said body portion and preventing said nipple portion from collapsing upon being sucked by a newborn, said tube being less flexible than said nipple portion and cooperating therewith to provide the feel and flexibility of a mother's breast.

2. The nipple configuration of claim 1 wherein said nipple portion includes a pair of flexible wing members extending along the axial length of said nipple portion and projecting outwardly therefrom in opposed lateral directions, said wing members tapering outwardly toward perimeter edges thereof such that said members increase in flexibility toward said edges.

3. The nipple configuration of claim 2 wherein said wing members are integrally formed with said nipple and body portions.

4. The nipple configuration of claim 3 wherein said nipple portion has an axial length of about 1.0 to 1.125 inches.

5. The nipple configuration of claim 1 wherein said nipple portion has an axial length of about 1.0 to 1.125 inches.

6. A nipple configuration for use on a baby bottle for simulating a mother's breast in the feeding of newborns, said configuration comprising:

a body portion defining a convex outer surface disposed about an interior area; a base portion extending from said body portion for securing said nipple configuration to the baby bottle;

a nipple portion projecting outwardly from said body portion, and a plurality of fluid discharge openings in an extended end thereof, at least said body and nipple portions being formed of a soft flexible material and having a plurality of surface irregularities formed therein;

wherein said nipple portion defines a fluid passageway extending axially therethrough and including a flexible reinforcing tube extending through said passageway communicating said fluid openings with said interior of said body portion and preventing said nipple portion from collapsing upon being sucked by a newborn; and wherein said flexible reinforcing tube is less flexible than the material of which said nipple portion and cooperates therewith to provide the feel and flexibility of a mother's breast.

7. The nipple configuration of claim 6 wherein said nipple portion has an axial length of about 1.0 to 1.125 inches.

8. The nipple configuration of claim 6 wherein said nipple portion defines an inner end and an outer end and includes a pair of flexible wing members which extend along the axial length of said nipple portion, said wing members being configured to define perimeter edges extending outwardly in opposite directions from said outer end of said nipple and converging toward said inner end thereof, and tapering from said nipple portion in opposed lateral directions, whereby said wing members increase in flexibility toward perimeter edges thereof.

9. The nipple configuration of claim 8 wherein said nipple portion has an axial length of about 1.0 to 1.125 inches.

10. A nipple configuration for use on a baby bottle for feeding newborns having a cleft-lip and/or palate, said configuration comprising:

a body portion defining a convex outer surface disposed about an interior area;

a base portion extending from said body portion for securing said nipple configuration to the baby bottle and a nipple portion projecting outwardly from said body portion, at least said body and nipple portions being formed of a soft flexible material and wherein said nipple portion defines a fluid passageway extending axially therethrough, a plurality of fluid discharge openings in an extended end thereof; and a pair of flexible wing members extending along the axial length of said nipple portion, said wing members configured to define perimeter edges extending outwardly in opposed directions from said nipple portion and tapering outwardly from said nipple portion, whereby said wing members increase in flexibility toward perimeter edges thereof; and a flexible reinforcing tube extending through said passageway in said nipple portion communicating said fluid openings with said interior of said body portion and preventing said nipple portion from collapsing upon being sucked by a newborn.

11. The nipple configuration of claim 10 wherein said nipple portion and said convex outer surface of said body portion define surface irregularities therein to simulate the outer surface of a mother's nipple and areola.

12. The nipple configuration of claim 11 wherein said nipple portion has an axial length of about 1.0 to 1.125 inches.

13. The nipple configuration of claim 12 wherein said wing members are integrally formed with said nipple, body and base portions.

14. A breast shield adapted to be placed over a mother's breast and nipple for nursing a newborn, said shield being formed of a soft flexible material and defining a body portion and a nipple portion, said body portion having a curvilinear outer surface defining a plurality of surface irregularities therein and a smooth interior surface, said nipple portion projecting outwardly from said body portion and defining a first fluid passageway extending axially therethrough, a plurality of surface irregularities to simulate the outer surfaces of a mother's nipple and areola, thereon and a plurality of fluid discharge openings in an extended end thereof and including a flexible reinforcing tube extending through said passageway communicating said fluid openings with the interior of said body portion and preventing said nipple portion from collapsing upon being sucked by a newborn.

15. The breast shield of claim 14 wherein said nipple portion includes a pair of flexible wing members extending along the axial length of said nipple portion and projecting outwardly therefrom in opposed lateral directions, said wing members tapering outwardly toward perimeter edges thereof such that said members increase in flexibility toward said edges.

16. A breast shield adapted to be placed over a mother's breast and nipple for nursing a newborn, said shield being formed of a soft flexible material and defining a body portion and a nipple portion, said body portion having a curvilinear outer surface defining a plurality of surface irregularities therein and a smooth interior surface, said nipple portion projecting outwardly from said body portion and defining a first fluid passageway extending axially therethrough, a plurality of surface irregularities thereon to simulate the outer surfaces of a mother's nipple and areola and a plurality of fluid discharge openings in an extended end thereof and including a flexible reinforcing tube extending through said passageway communicating said fluid openings with the interior of said body portion and preventing said nipple portion from collapsing upon being sucked by a newborn, and a second fluid passageway carried by said body portion and defining an upstream end and a downstream end, said downstream end being disposed proximate said reinforcing tube in said nipple portion and said upstream end being disposed exteriorly of said body portion such that upon communicating said upstream end with a supply of breast milk or formula, said breast milk or formula can be directed to the newborn through said second fluid passageway and said reinforcing tube.

17. The breast shield of claim 16 wherein said second fluid passageway is formed in said body portion of said breast shield and including a closure member carried by said shield for selectively sealing said upstream end of said second fluid passageway.

18. The breast shield of claim 16 wherein said nipple portion includes a pair of flexible wing members extending along the axial length of said nipple portion and projecting outwardly therefrom in opposed lateral directions, said wing members tapering outwardly toward perimeter edges thereof such that said members increase in flexibility toward said edges.

19. The breast shield of claim 18 wherein said second fluid passageway is formed in said body portion of said breast shield and including a closure member carried by said shield for selectively sealing said upstream end of said second fluid passageway.

20. A pacifier adapted for use with newborns having cleft-lips and/or palates, said pacifier comprising:

body and nipple portions integrally formed of a soft flexible material, said body portion defining a convex outer surface having a plurality of surface irregularities therein, said nipple portion projecting outwardly from said body portion and having a plurality of surface irregularities thereon;

a reinforcing member extending therethrough; and a pair of flexible wing members extending along the axial length of said nipple portion, said wing members configured to define perimeter edges extending outwardly in opposed directions from said nipple portion and tapering outwardly from said nipple portion, whereby said wing members increase in flexibility toward perimeter edges thereof.

* * * * *